United States Patent [19]

Stockli et al.

[11] 4,294,022

[45] Oct. 13, 1981

[54] BOOTS FOR AQUATIC ACTIVITIES

[76] Inventors: Andre Stockli, 2086 Prieur St.; Fernando Castaneda, 7838 Casgrain St., both of Montreal, Quebec; Jean-Louis Stockli, 3112 Gerard St., Fabreville, Quebec, all of Canada

[21] Appl. No.: 101,214

[22] Filed: Dec. 7, 1979

Related U.S. Application Data

[63] Continuation of Ser. No. 922,070, Jul. 5, 1978, abandoned.

[51] Int. Cl.[3] ..... A43B 1/02; A43B 1/10

[52] U.S. Cl. ..... 36/4; 36/9 R

[58] Field of Search ..... 36/9 R, 4, 7.1, 45, 36/117

[56] References Cited

U.S. PATENT DOCUMENTS

| | | | |
|---|---|---|---|
| 2,838,854 | 6/1958 | Dosmann | 36/4 |
| 3,016,631 | 1/1962 | Servin | 36/9 R |
| 3,264,761 | 8/1966 | Johnson | 36/9 R |
| 3,293,494 | 12/1966 | Fischer | 36/4 |
| 3,416,174 | 12/1968 | Novitske | 36/9 R |

*Primary Examiner*—Patrick D. Lawson

[57] ABSTRACT

This invention relates to boots for divers, used in association with a wet suit, dry suit, other diving gears or for other aquatic activities. Each boot comprises a sock, made of elastomeric material, preferably covered by nylon fabric on one or two sides, and an outsole, together with a back stay, a toe-cap and a foxing, made of non-cellular rubber and directly vulcanized as a unit on the sock. The resulting boot is long-lasting because the outsole does not become detached from the sock. Vulcanization is carried out in such a way that it does not affect the cellular elastomeric material.

9 Claims, 5 Drawing Figures

BOOTS FOR AQUATIC ACTIVITIES

This application is a continuing application of U.S. patent application Ser. No. 922,070, filed July 5, 1978, now abandoned.

The present invention relates to boots useful in aquatic activities, particularly in underwater diving.

Such boots are normally made from a sock rising to just above the ankle, with the sock having an outsole of rubber. The sock itself is normally made by stitching together pieces of cellular elastomer, preferably covered by one of two pieces of fabric, of nylon or similar synthetic yarn. A rubber outsole is then adhered to the bottom of the sock. One known type of outsole is a precut piece which is cemented and stitched to the sock all around the edge of the outsole. In such a known construction, in order for the outsole to be stitched to the sock, it must be made of low grade flexible and soft rubber and the latter, together with the stitching itself, can be easily torn away from the sock during use. Another known type of outsole consists of a molded rubber piece which is cemented to the sock. It has been found that such conventional divers' boots do not last very long.

It is an object of the invention to provide a boot, which obviates the above-noted disadvantages in that the rubber outsole is directly molded and vulcanized in situ and adheres to the sock without any stitching.

More specifically, the boot of the present invention comprises a sock made of a cellular elastomeric material, including an insole and an upper, and an outsold assembly consisting substantially of a non-cellular rubber composition covering the insole and the adjacent part of the upper all around the insole, said outsole assembly being vulcanized in situ and adhering to the sock.

Preferably, said elastomeric material is cellular neoprene, and the rubber composition of the outsole assembly is natural rubber.

A preferred embodiment of the present invention will be hereinafter described with reference to the accompanying drawings, wherein.

In the drawings, like reference characters indicate like elements throughout.

Figure 1:
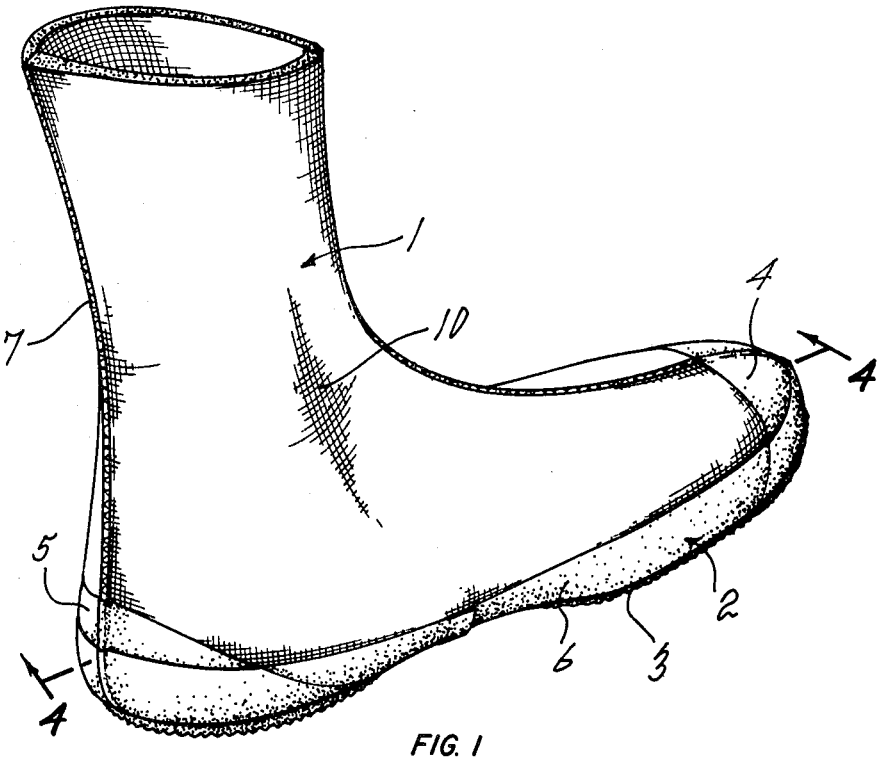
FIG. 1 is a perspective view of a boot in accordance with the invention.
Figure 2:
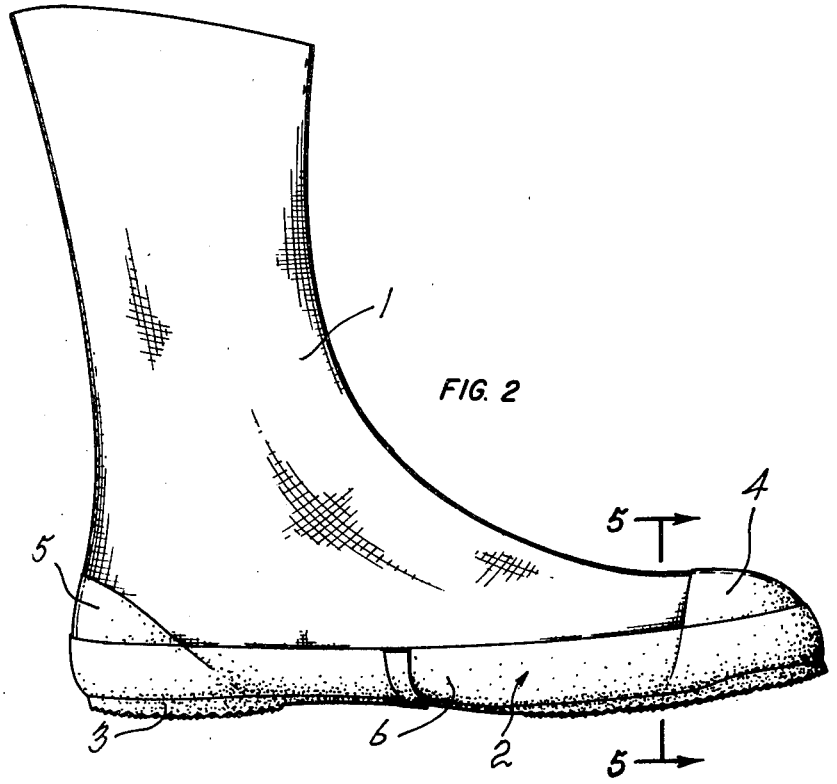
FIG. 2 is a side elevation of the same.
Figure 3:
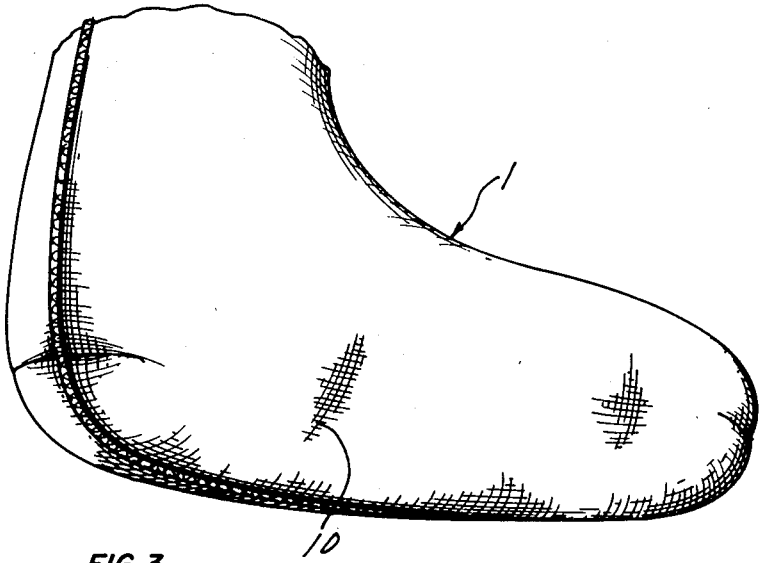
FIG. 3 is a perspective view of the sock proper, the upper portion being cut away.
Figure 4:
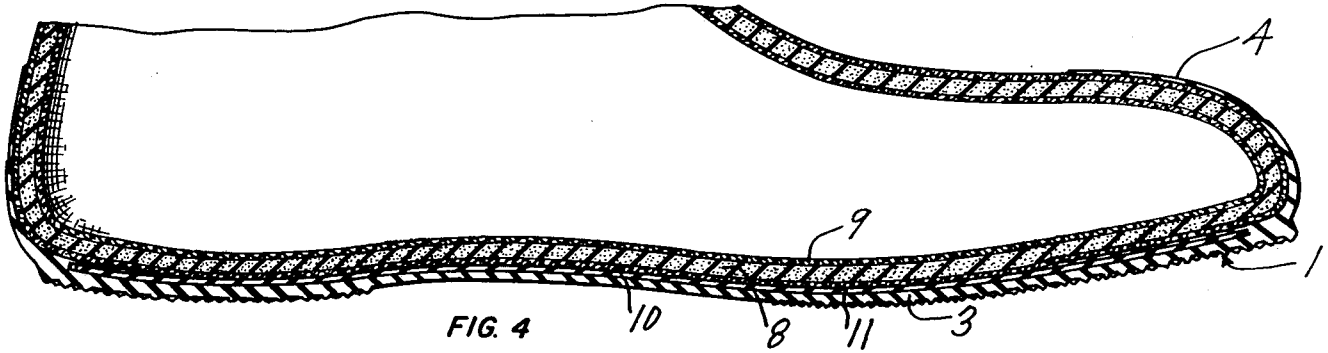
FIG. 4 is a longitudinal section of the boot, taken along line 4—4 of FIG. 1.
Figure 5:
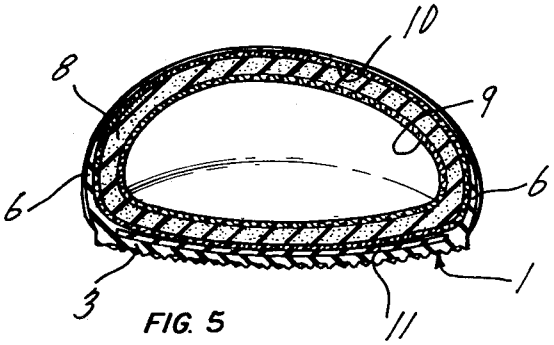
FIG. 5 is a cross-section, taken along line 5—5 of FIG. 2.

As illustrated in the drawings, the boot comprises a sock 1, covered in part by an outsole assembly, generally indicated at 2, and made of rubber. The outsole assembly more specifically includes an outsole proper, indicated at 3, a toe-cap 4 covering the toe portion of the sock 1, a back stay 5 covering the heel portion of the sock 1 and a foxing 6 surrounding the entire lower edge of the sock 1 and forming an integral unit with the outsole 3, the toe-cap 4 and the back 5.

The sock 1 is made from at least one piece of flexible and heat-insulating material, properly cut and stitched to form the sock. In the example shown, two pieces are used; they are stitched together by the line of stitching 7 extending in the central vertical plane of the sock.

Thus, the insulating material is made of a layer 8 of cellular synthetic elastomer, such as cellular neoprene. Layer 8 may be used as is, or one or both faces of which can be covered by a fabric of synthetic yarn, such as nylon, adhering to layer 8. The drawings show an inside fabric 9 and an outside fabric 10. As an example, thickness of the sock may vary from 5 to 7 millimeters and it has a high thermal insulation property, is highly flexible and absorbs water, a maximum of about five percent by weight of the material.

This sock is made in a conventional manner in the making of the boot. Once the sock has been prepared, a metal last is inserted therein to impart to the sock the shape of a boot with a sole surface. The underside and the lower edges of the sock are then covered with a first coat of a neoprene base cement which adheres to cellular neoprene layer 8 by being absorbed through the fabric 10 and which also adheres to the outside fabric 10, the latter being generally made of nylon. Then, a second coat of cement, namely a natural rubber base cement, is applied on the first coat. The second coat adheres to the first coat and also to the outsole assembly 2, since the latter is made of natural rubber. The various rubber parts are then applied to the cement-coated sock. First, a filler 11 is applied and adhered to the sole surface; filler 11 consists of a fabric impregnated with natural unvolcanized rubber and of about 45 thousandths of an inch thick; unvulcanized natural rubber parts including the toe-cap 4, the back stay 5 and the foxing 6 are then applied and adhered to the sock 1 and to the filler fabric 11 in their proper position. The outsole 3 is then applied and adhered to the sock, and the entire assembly is then placed in an autoclave subjected to heat and pressure to vulcanize the outsole assembly 2 in situ. The vulcanization, or curing cycle, is such that the natural rubber components are progressively brought to a temperature of a maximum of 240° F. during one hour and then cured for another three hours at 240° F., such temperature being chosen so as not to degrade the elastomeric property of the sock material. The autoclave is then opened and the resulting boot has its proper shape and has its outsole assembly vulcanized in situ and firmly adhering to the sock. No stitching whatever is needed to attach the outsole assembly to the sock. Since no stitching is required, high grade natural rubber parts are selected to make the outsole assembly.

It is to be noted that it is important not to exceed the degrading temperature of the sock material in the vulcanization step. In this respect, a vulcanizing cycle of $1\frac{3}{4}$ hour at 30 pound-pressure with a curing cycle of first one-half hour with a temperature rising up to 270° F. and with a further $1\frac{1}{4}$ hour with a temperature remaining at 270° F., has been tried. However, in that experiment, it was noted that the temperature and vulcanizing cycle used caused a great reduction in the thickness of the foam of the sock, which would have resulted in a great loss in the heat-insulating property of the material of the sock.

In the vulcanizing cycle used, it is to be noted that a lower temperature than 240° F. could be used; but then with a longer curing cycle. In fact, room temperature could be used for vulcanization; but the curing cycle would last one week, which is not practical.

The pressure used during vulcanization is normally 30 pounds, but could be as low as 10 pounds per square inch.

What we claim is:

1. A boot useful in aquatic activities, particularly in underwater diving, comprising a sock made of a cellular elastomeric material and including an insole and an upper; an outsole assembly consisting substantially of a non-cellular rubber composition covering the insole and the adjacent part of the upper all around the insole, said outsole assembly being vulcanized in situ and adhering to the sock.

2. A boot as claimed in claim 1, wherein said elastomeric material is cellular neoprene and is covered by a fabric adhering thereto over its entire outer surface, including said insole.

3. A boot for divers and the like as defined in claim 2, wherein the rubber of said outsole assembly is natural rubber, and further including a first coat of neoprene base cement coating said outside fabric and said cellular neoprene through the interstices of said outside fabric, said first coat coating said insole and said adjacent part of the upper, and a second coat of natural rubber base cement applied to said first coat and in direct contact with said outsole assembly.

4. A boot as defined in claim 1 or 2, wherein said outsole assembly includes an outsole extended by a back stay at the heel of the boot, by a toe-cap at the toe portion of the boot and by a foxing along the lower edge of the boot all around the same, said back stay, toe-cap and foxing forming an integral assembly with said outsole.

5. A boot as defined in claim 2 or 3, wherein said fabric is a thermo-plastic.

6. A boot as defined in claim 2 or 3, wherein said fabric is made of nylon yarn.

7. A boot for divers comprising a sock and an outsole assembly, said sock made of a central layer of cellular neoprene having an inner and an outer surface, an inside and an outside fabric adhering to said central layer over the entire inner and outer surfaces of said central layer, said sock forming an inner sole and an upper, being completely closed, except for a top opening for the passage of the user's foot, and made of two half-parts stitched together by a line of stitching extending in the central, vertical plane of the sock, said outsole assembly consisting of a major part of a natural, non-cellular rubber composition and covering the insole and the adjacent part of the upper all around the insole, said outsole assembly vulcanized in situ and adhering to the sock.

8. A boot for divers as defined in claim 7, further including a first coat of neoprene base cement coating said outside fabric and said central layer through the interstices of said outside fabric, said first coat coating said insole and said adjacent part of the upper, and a second coat of natural rubber base cement applied to said first coat and in direct contact with said outsole assembly.

9. A boot as defined in claim 7, wherein said outsole assembly includes an outsole extended by a back stay at the heel of the boot, by a toe-cap at the toe portion of the boot and by a foxing along the lower edge of the boot all around the same, said back stay, toe-cap and foxing forming an integral assembly with said outsole.

* * * * *